US011027941B2

(12) United States Patent
Freedman et al.

(10) Patent No.: US 11,027,941 B2
(45) Date of Patent: Jun. 8, 2021

(54) SLABBING MACHINE

(71) Applicants: Melvin Freedman, Chicago, IL (US); Thomas Landwehr, De Pere, WI (US)

(72) Inventors: Melvin Freedman, Chicago, IL (US); Thomas Landwehr, De Pere, WI (US)

(73) Assignee: Product Solutions Int'l, LLC, Highland Park, IL (US)

( * ) Notice: Subject to any disclaimer, the term of this patent is extended or adjusted under 35 U.S.C. 154(b) by 0 days.

(21) Appl. No.: 16/791,480

(22) Filed: Feb. 14, 2020

(65) Prior Publication Data

US 2020/0262674 A1 Aug. 20, 2020

Related U.S. Application Data

(63) Continuation-in-part of application No. 16/275,886, filed on Feb. 14, 2019, now abandoned.

(51) Int. Cl.

| | |
|---|---|
| ***B65H 73/00*** | (2006.01) |
| ***B26D 7/18*** | (2006.01) |
| ***B26D 1/16*** | (2006.01) |
| *B26D 7/00* | (2006.01) |

(52) U.S. Cl.

CPC ..... *B65H 73/00* (2013.01); *B26D 1/16* (2013.01); *B26D 7/1854* (2013.01); *B26D 2007/0018* (2013.01); *B26D 2210/11* (2013.01)

(58) Field of Classification Search

CPC ..... B65H 73/00; B26D 1/16; B26D 4/1854; B26D 2007/0018; B26D 2210/11

See application file for complete search history.

(56) References Cited

U.S. PATENT DOCUMENTS

| | | | | |
|---|---|---|---|---|
| 4,676,557 | A * | 6/1987 | Shope | B23D 59/02 125/28 |
| 4,864,906 | A * | 9/1989 | Hall | B26D 1/18 83/886 |
| 5,759,350 | A * | 6/1998 | Pyron | B26D 3/001 162/191 |
| 6,761,098 | B1 * | 7/2004 | Esping | B26D 3/001 83/102 |
| 8,196,501 | B2 * | 6/2012 | Bilskie | B26D 1/18 83/649 |
| 9,862,565 | B2 * | 1/2018 | Karlsson | B65H 73/00 |
| 2004/0255744 | A1 * | 12/2004 | Becker | B26D 1/0006 83/13 |
| 2005/0000332 | A1 * | 1/2005 | Ennis | B26F 1/40 83/13 |
| 2007/0014948 | A1 * | 1/2007 | Couchey | B65H 73/00 428/34.2 |

(Continued)

*Primary Examiner* — Omar Flores Sanchez
(74) *Attorney, Agent, or Firm* — Donald J. Ersler

(57) ABSTRACT

Slabbing machine for removing material M wound around a reel R, comprising a frame; a structure for holding the material M wound around the reel R; a beam connected to the frame and displaceable along the frame in a radial direction y; a blade holder connected to the beam and displaceable along the beam in a longitudinal direction x perpendicular to the radial direction y; a blade mounted on the blade holder for cutting the material M down to a cutting plane p perpendicular to the radial direction y and located at the farthest end of the blade in radial direction y; wherein one or several air outlets are mounted on the blade holder 1 and directed towards the cutting plane p for blowing air towards the cutting plane p.

11 Claims, 7 Drawing Sheets

(56) References Cited

U.S. PATENT DOCUMENTS

| | | | | |
|---|---|---|---|---|
| 2015/0344264 | A1* | 12/2015 | Karlsson | B65H 73/00<br>83/872 |
| 2018/0250683 | A1* | 9/2018 | Stokes | B02C 18/02 |
| 2018/0345654 | A1* | 12/2018 | Bormann | B31B 50/16 |

* cited by examiner

SLABBING MACHINE

FIELD OF THE INVENTION

The present invention relates to a slabbing machine for removing material wound around a reel.

BACKGROUND OF THE INVENTION

In many industries web material is used and provided on reels around which the material is wound tightly. The producer of such reels is often encountered with reels of material where either the material is defective due to poor printing, poor coating, wrinkles or other issues. In these cases, in order to allow recycling or disposal to landfill the web material must be removed from the reel, which can also be recycled if it is not defective, i.e. in the case of paper.

Removing the web material from the reel is tedious if carried out manually, because the web material is wound tightly in many layers and is often too thick to be cut in one go. An operator seeking to remove the web material from the reel has to cut a small number of layers at a time and repeat the operation many times. In addition to cutting through the layers of web material, the operator may also have to actively pull these off the reel, especially if the different layers stick together, and deal with the web material cut off as it may crowd the working area. Altogether, the manual process is slow, laborious and there is an inherent risk of injury for a number of reasons. Commonly injuries occur due to the manipulation of a sharp knife or due to repeated use of a hand knife, which often results in wrist, elbow or shoulder muscular or skeletal problems.

SUMMARY OF THE INVENTION

The main object of the present invention is to provide an improved slabbing machine for removing material wound around a reel easily, efficiently and automatically, without any manual interaction.

DETAILED DESCRIPTION OF THE INVENTION

Figure 1A:
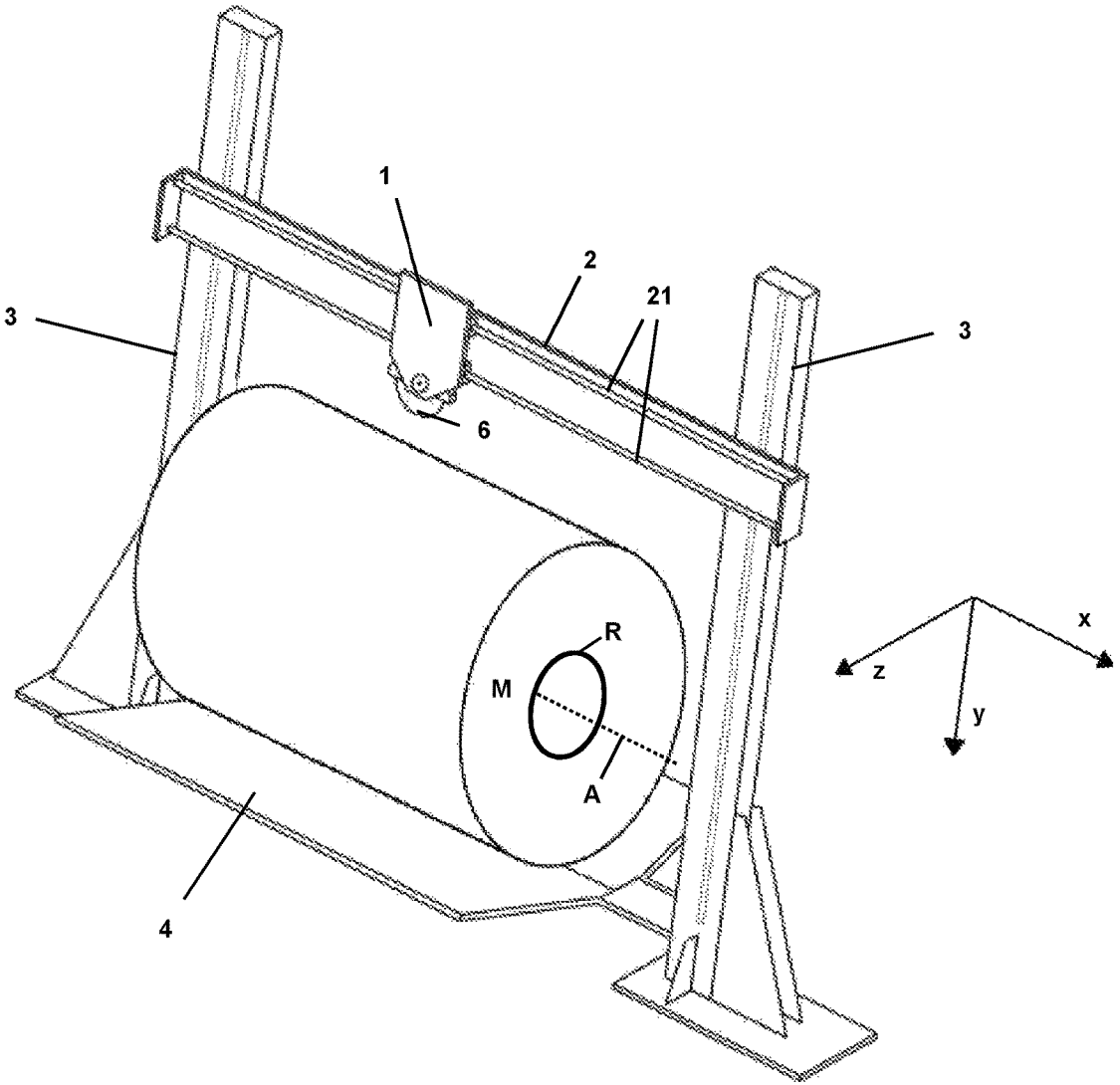
FIG. 1*a* Slabbing machine, perspective view
FIG. 1*b* Slabbing machine with bin, perspective view
FIG. 1*c* Blade holder, side view
FIG. 2 Blade holder, perspective view
FIG. 3*a* Blade holder, close-up perspective view
FIG. 3*b* Blade holder during a cut, close-up side view
FIG. 3*c* Blade holder, close-up exploded view Preferred embodiments of the slabbing machine are described according to the drawings. These preferred embodiments are to be understood as exemplary embodiments and any detailed description shall not be interpreted as limiting.
Figure 1B:
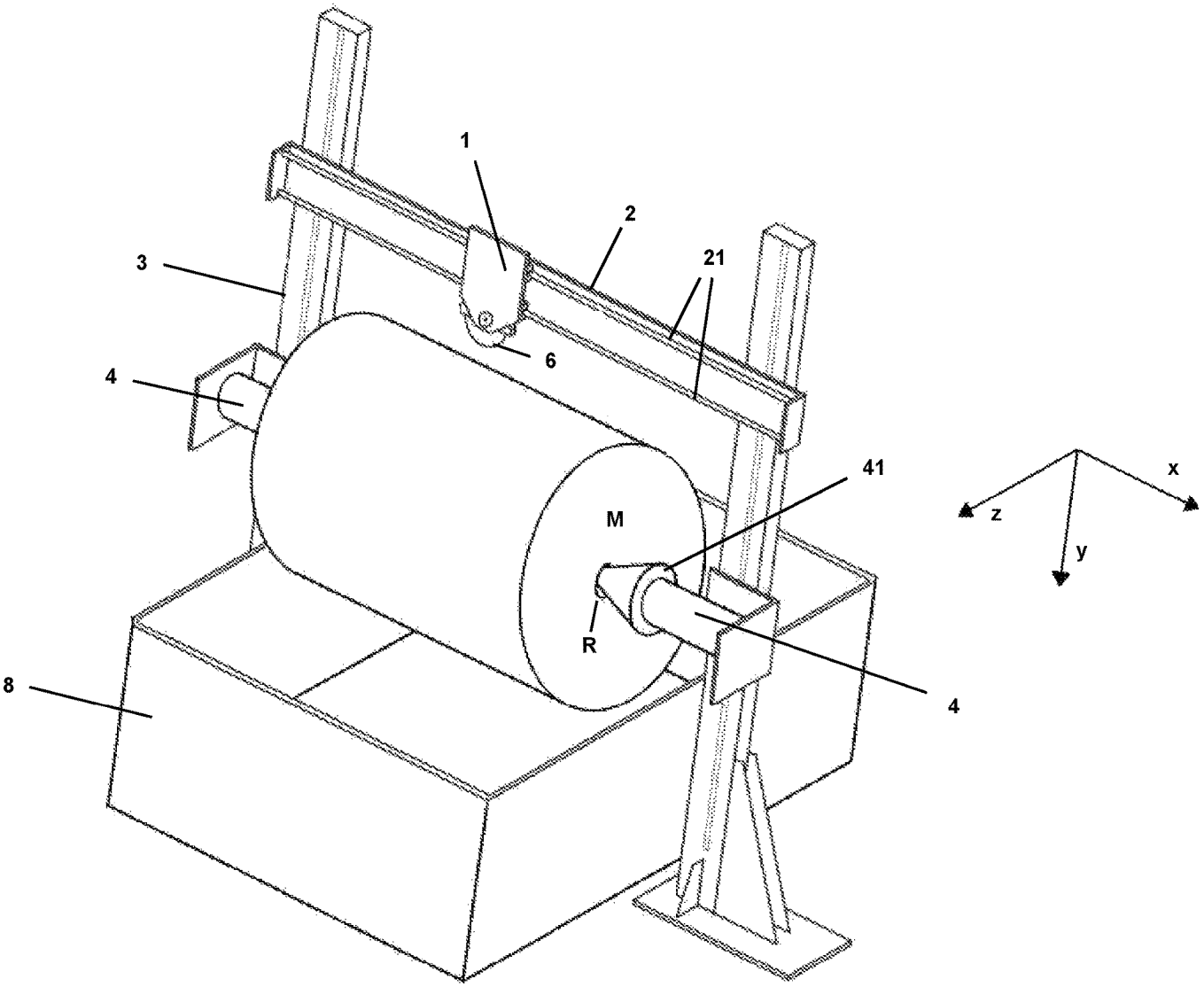
Figure 1C:
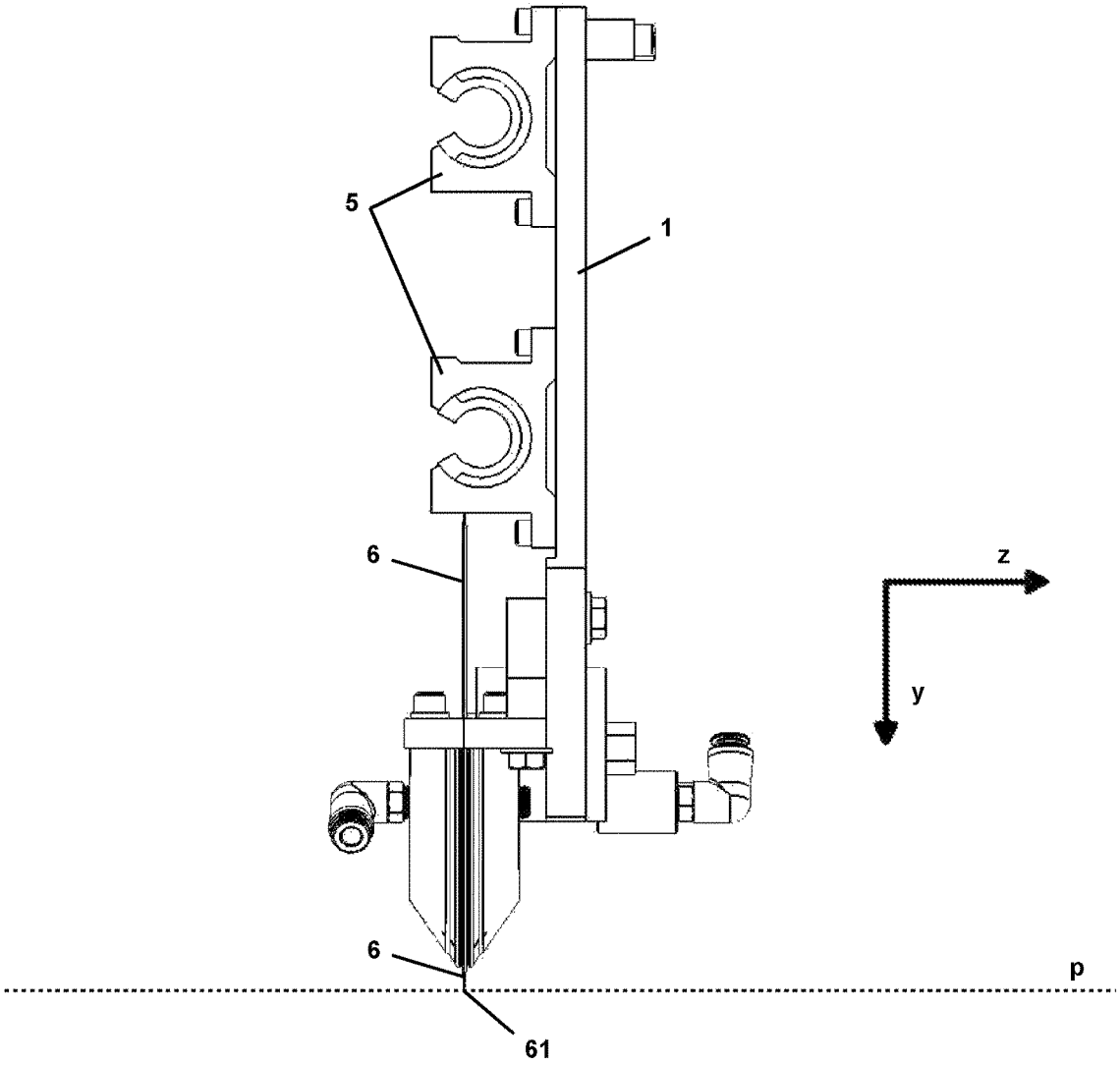

The slabbing machine comprises a frame 3 and a structure 4 connected to the frame 3 for firmly holding a reel R, around which a material M is wound, in a way preventing any movement of the reel R relative to the frame 3 (FIGS. 1*a-b*). A beam 2 is connected to the frame 3 and is displaceable along the frame 3 in a radial direction y, from one end position to the other end position and back. A blade holder 1 is connected to the beam 2 and displaceable along the beam 2 in a longitudinal direction x perpendicular to the radial direction y (in both ways). A blade 6 is mounted on the blade holder 1 for cutting the material M down to a cutting plane p (FIG. 1*c*). This cutting plane p is perpendicular to the radial direction y and located at the farthest end 61 of the blade 6 in radial direction y, i.e. the end 61 of the blade 6 which is the nearest to the reel R and which will cut the material M. The structure 4 holds the central longitudinal axis A of the reel R in the plane defined by the longitudinal and radial directions x, y. This way, the blade holder 1 is displaceable in both directions in the longitudinal direction x parallel to the central longitudinal axis A of the reel R and in the radial direction y towards and away from the central longitudinal axis A of the of the reel R.

Figure 2:
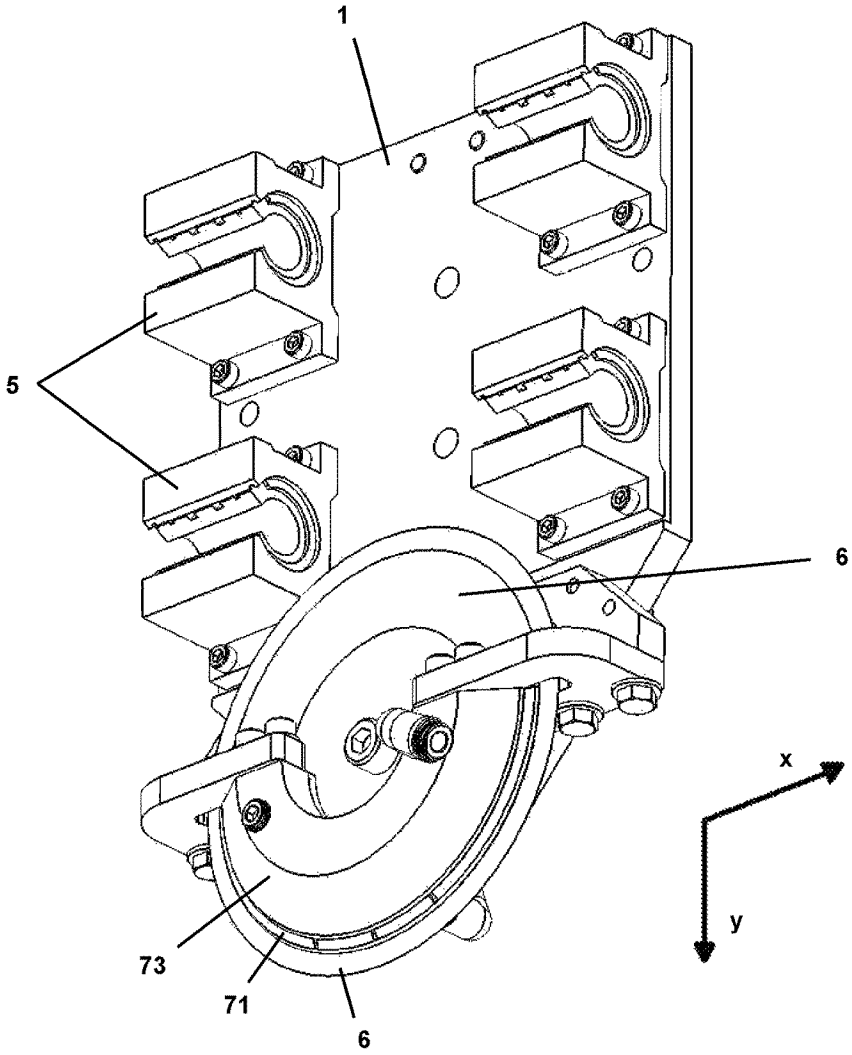

The blade holder 1 is affixed to the beam 2 with attachment means 5, preferably to one or more longitudinal guides 21. The blade 6 is arranged on the blade holder 1 parallel to the longitudinal direction x (FIG. 2). In the preferred embodiment of the invention, the blade 6 is circular and may rotate (freely or forcibly, e.g. with a motor) or not during the cut depending on the type of material M to be removed from the reel R.

In order to remove the material M from the reel R, the blade holder 1 is first placed near the material M in a first starting position. In the first starting position, the blade 6 is placed beside the material M (in longitudinal direction x) and the cutting plane p is below the surface of the material M. Then, the blade holder 1 is moved along the beam 2 in the longitudinal direction x from the first starting position to a first ending position at the other end of the material M. The blade 6 thereby cuts a certain number of outer layers of material M down to the cutting plane p across the whole length of the reel R. These outer layers of Material M are then free to fall off on either side of the cut. Before starting another cut, the blade holder 1 is moved further towards the center of the reel R in radial direction y from the first ending position to a second starting position. The longitudinal cuts are repeated and the blade holder 1 is driven incrementally towards the center of the reel R until the cutting plane p is tangential to the outer circumference of the reel R. After this final cut, all the layers of material M have been cut and can fall off the reel R.

In one embodiment of the slabbing machine, the structure 4 is a V-shaped plate 4 on which the reel R, around which the material M is wound, is placed. The V-shape of the plate 4 prevents the reel R from rolling away, thus effectively securing it in place and holding the central longitudinal axis A of the reel R in the plane defined by the longitudinal and radial directions x, y. The plate 4 may be movable in direction y along the frame 3.

In order to prevent accidental rotation of the reel R, in a preferred embodiment of the slabbing machine, the structure 4 consists of two arms 4 with conical ends 41 pointing towards the center of the slabbing machine, arranged on each side of the frame 3, which can be extended into the reel R, effectively securing it in place (FIG. 1*b*). The conical shape of the ends 41 of the guides 4 allow to secure reels R whose central openings have different diameters. Preferably, the structure 4 is movable in direction y along the frame 3. Besides, the location of the structure 4 on the frame can be such that it allows the placement of a bin or container 8 underneath the reel R. The layers of the material M removed from the reel R fall into the bin or container 8 which can be easily transported to the disposal or recycling site as soon as the material M is completely removed. For heavy material M, the bin or container 8 can be placed on a pallet allowing it to be removed with a pallet jack or forklift. In a preferred embodiment the container 8 is a tipping dumpster allowing the container to be moved with a forklift and easily emptied into a larger container or a truck for further transport.

Figure 3A:
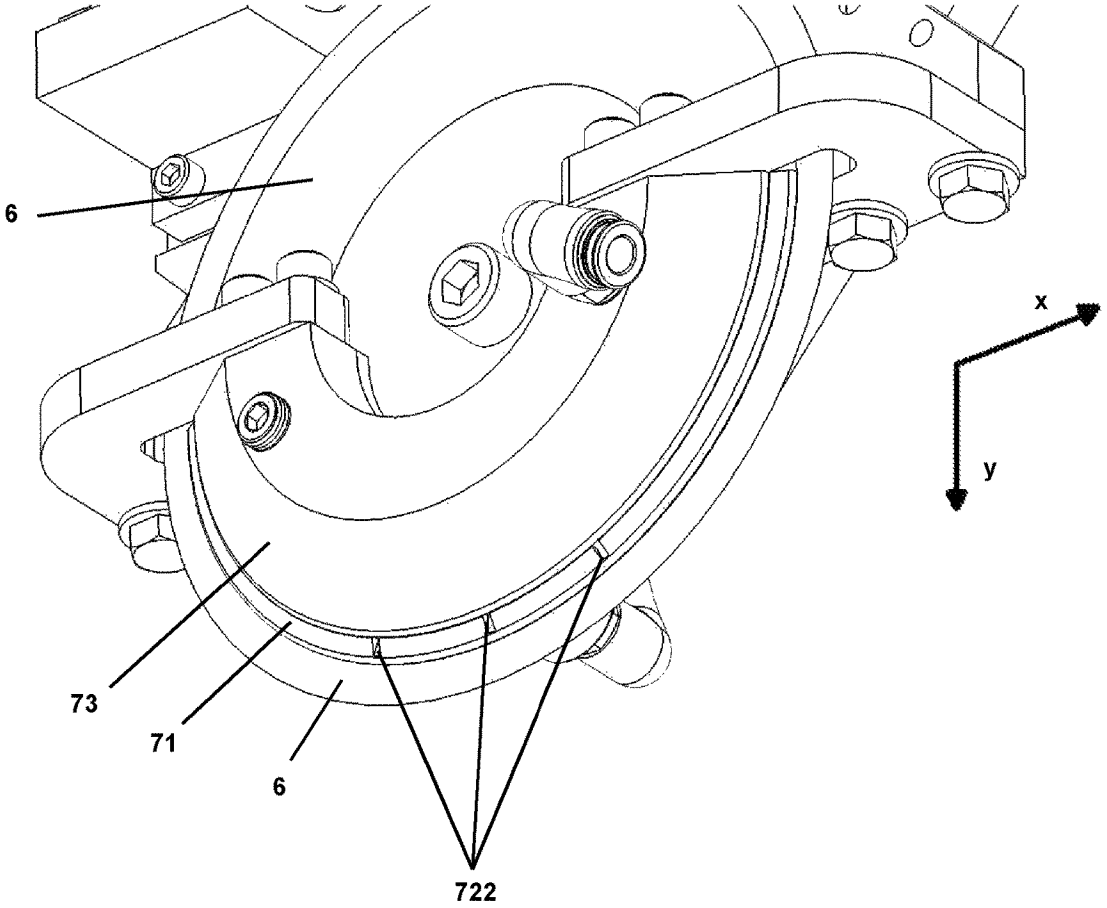
Figure 3B:
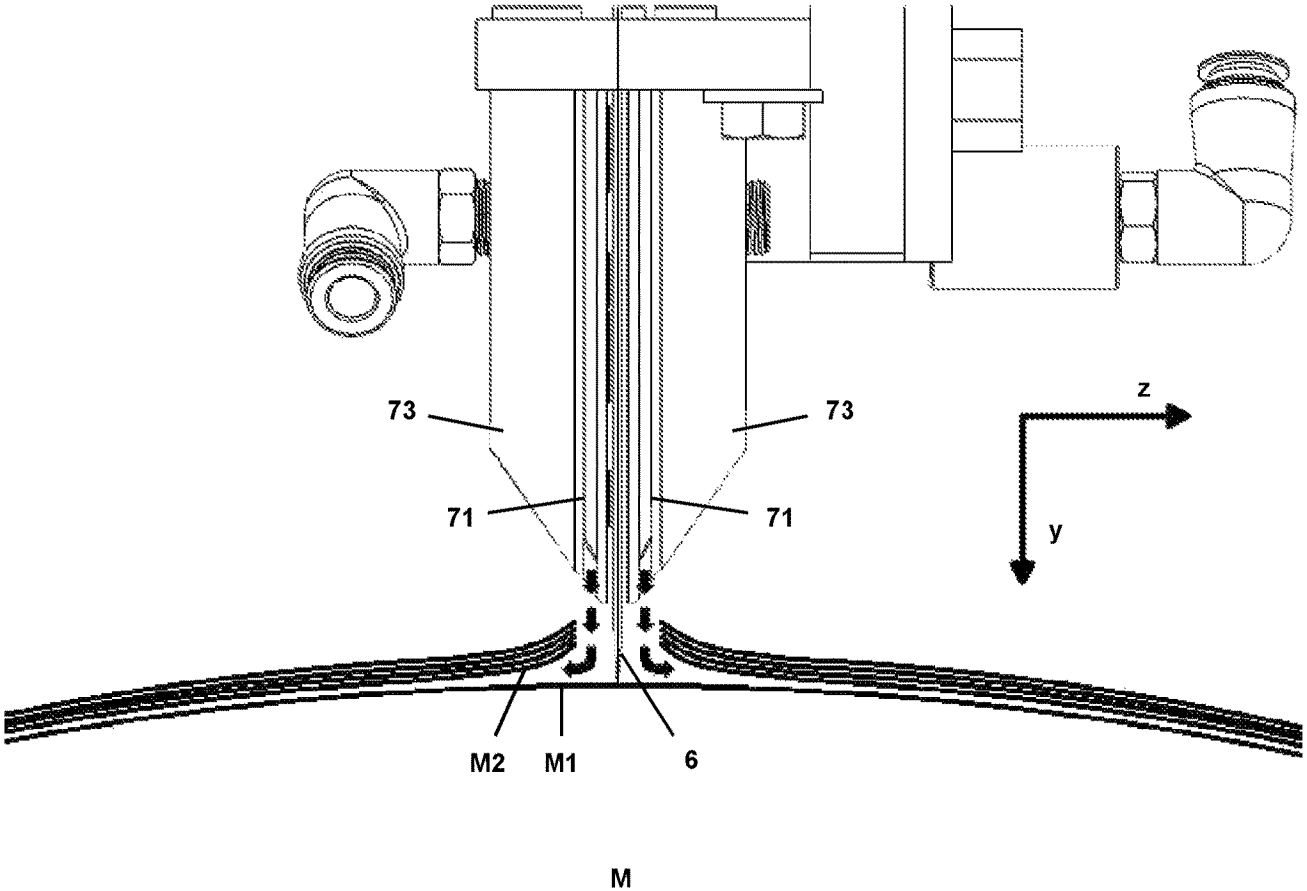

It often happens that the outer layers of material M which have been severed don't fall off spontaneously as a result of a tight winding or because the layers of material M stick together. It has been found that the outer severed layers of material M fall off more easily when an air cushion is formed between the already cut layers and the underlying layers still wound around the reel R. Preferably, the air cushion is formed between the last outer severed layer M2 and the first layer M1 which has been left uncut by the blade 6 (FIG. 3*b*). The air cushion lifts the outer severed layers, separates them from the underlying layers and allows them to fall off spontaneously due to gravity. The air cushion is formed by blowing air towards the center of the reel R on one or both sides of the blade 6. This is done by providing the blade holder 1 with air outlets 722 arranged on one or both sides of the blade 6 and directed towards the cutting plane p for blowing air towards the cutting plane p (FIGS. 3*a-b*). In a possible embodiment of the invention, one or several air outlets (722) are oriented parallel to the plane defined by the longitudinal and radial directions (x, y).

The air outlets 722 may have different sizes and shapes depending on the size of the reel R, the type and thickness of the material M, the size of the blade 6 and their position on the blade holder 1. For example, there could be one or several rows of circular air outlets 722 arranged along the longitudinal direction x or one or several air outlets 722 with an elongated shape in longitudinal direction x. Preferably, the air outlets 722 are arranged symmetrically on both sides of the blade 6 and located on the blade holder 1 as close as possible to the blade 6 and the cutting plane p. However, in order not to contact the material M during a cut, the air outlets 722 are preferably positioned at a distance from the cutting plane p. This distance corresponds to at least the cutting depth of the blade, but can be larger to prevent contact with the material M already cut, if this has not yet fallen off the reel R. The air outlets 722 may also be arranged only behind or in front of the blade 6 in longitudinal direction x in order to better inject air between the layers of material M which have been cut from the reel R either in the current cut or the previous one. Ideally, the air outlets 722 are arranged symmetrically around the center of the blade 6 in the longitudinal direction x, allowing them to work in the same manner independent of the moving direction of the blade holder 1.

In a preferred embodiment the air outlets 722 are arranged in at least one row on each side of the blade 6 and directed towards the cutting plane with varying orientations away from the blade and/or in the longitudinal direction x. To enable this the air outlets 722 can be equipped with set screws with openings of different sizes and orientations, allowing adjustments depending e.g. on the type of material M, the size of the reel R, the depth of the cut and the speed with which the blade 6 is moved in longitudinal direction x during a cut. In one special embodiment the air outlets 722 are equipped with rotating air nozzles, enabling the air flow to be in multiple directions for each air outlet 722. Ideally the air nozzles are suitable for creating ionized air flow preventing the layers of the material M from sticking together due to static electricity.

The air blown by the air outlets 722 may be pressurized and blown at different pressure or speed depending e.g. on the type of material M, the size of the reel R, the depth of the cut and the speed with which the blade 6 is moved in longitudinal direction x during a cut.

Figure 3C:
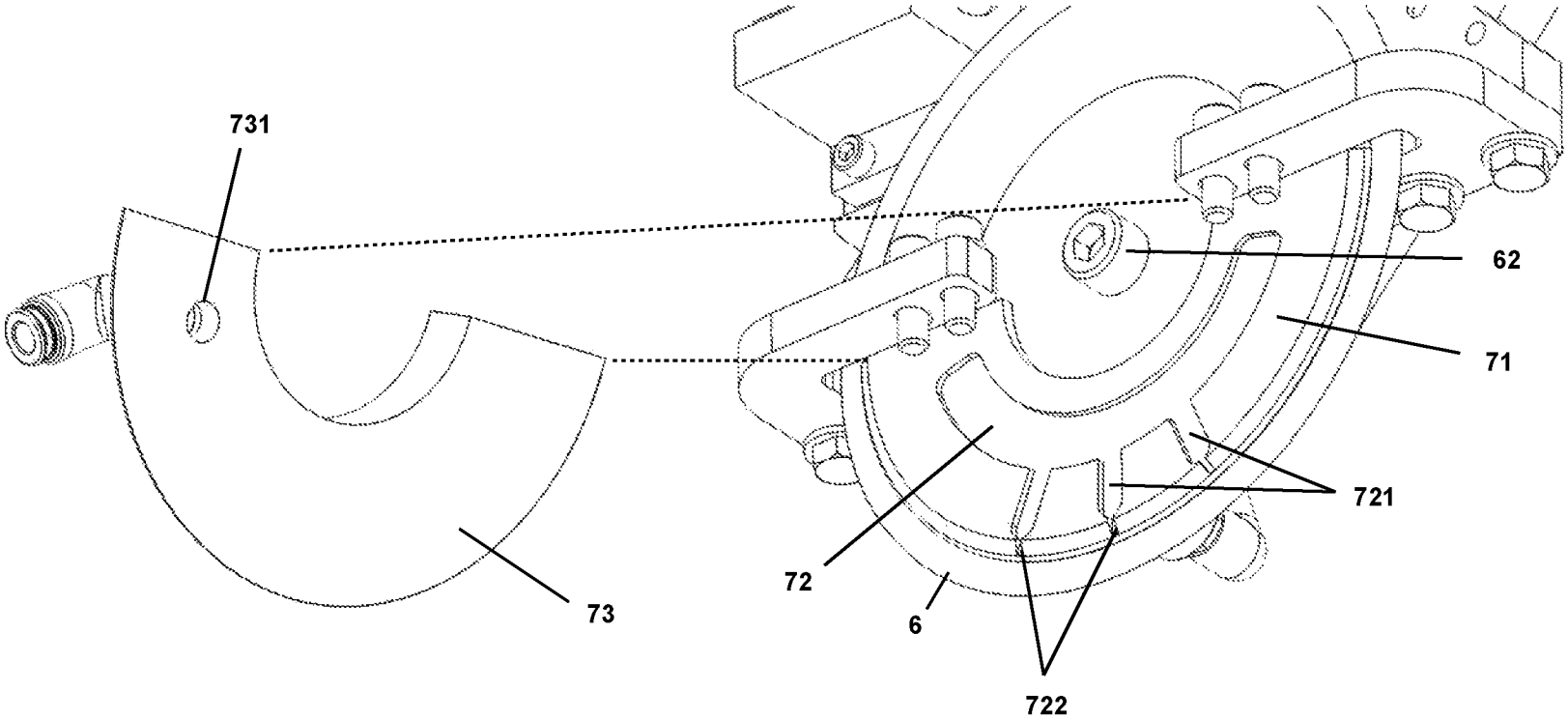

In the preferred embodiment of the invention, a substantially flat inner part 71 of the blade holder 1 is arranged in close vicinity of and parallel to the lower half of a side of the blade 6 (FIGS. 3*a-c*). The inner part 71 follows the circular contour of the blade 6, albeit with a smaller radius in order not to contact the material M during a cut. A groove 72 is arranged on a face of the inner part 71 not facing the blade 6 and has channels 721 leading to the air outlets 722 (FIG. 3*c*). The groove 72 is closed by an outer part 73 which is mounted on the inner part 71. The face of the outer part 73 facing the groove 72 may be flat or feature a corresponding groove. An inlet 731 is arranged in the outer part 73, allowing air to be brought to the groove 72 and blown out of the air outlets 722. The described arrangement of the inner and outer parts 71, 73 for providing the air outlets 722 on the side of the blade 6 is compact and robust. In particular, the system providing the air to the air outlets 722 would not be damaged should material M or other objects contact the inner or outer parts 71, 73 during the normal operation of the slabbing machine.

In the preferred embodiment of the invention, the air outlets 722 are advantageously located in the region of the inner part 71 which is the farthest from the center of the circular blade 6 in radial direction y. In the plane defined by the longitudinal and radial directions (x, y), the air outlets 722 may be oriented in radial direction y towards the central longitudinal axis A of the reel R and/or radially with respect to the center 62 of the circular blade 6 as shown in FIG. 3*c*. Additional air outlets may be arranged on different parts of the blade holder 1 and oriented in other directions.

The invention claimed is:

1. Slabbing machine for removing material (M) wound around a reel (R) comprising, a frame:

a structure for holding the material (M) wound around the reel (R);

a beam connected to the frame and displaceable along the frame in a radial direction (y);

a blade holder connected to the beam and displaceable along the beam in a longitudinal direction (x) perpendicular to the radial direction (y);

said blade holder comprising of an inner part and an outer part:

a blade mounted on the blade holder for cutting the material (M) down to a cutting plane (p) perpendicular to the radial direction (y) and located closest to the reel in radial direction (y);

several air outlets are mounted symmetrically on the blade holder on both sides of the blade and directed towards the cutting plane (p) for blowing air towards the cutting plane (p), wherein said inner part is arranged on the blade holder parallel to the lower half of a side of the blade and the face of the inner part not facing the blade has a groove with channels leading to the air outlets.

2. Slabbing machine according to claim 1, wherein one or several air outlets are oriented parallel to a plane defined by the longitudinal and radial directions (x, y).

3. Slabbing machine according to claim 2, wherein one or several air outlets are oriented in radial direction (y).

4. Slabbing machine according to claim 1, wherein the blade is circular.

5. Slabbing machine according to claim 4, wherein one or several air outlets are oriented radially with respect to the center of the circular blade.

6. Slabbing machine according to claim 1, wherein the groove is closed by the outer part which is mounted on the inner part.

7. Slabbing machine according to claim 1, wherein the blade is circular and the air outlets are located in the region of the inner part which is the farthest from the center of the circular blade radial direction (y).

8. Slabbing machine according to claim 1, wherein a bin or container is placed underneath the reel to receive the material (M) cut off the reel (R).

9. Slabbing machine according to claim 1, wherein the structure is a V-shaped plate.

10. Slabbing machine according to claim 1, wherein the structure consists of two arms with conical ends pointing towards the center of the slabbing machine, arranged on each side of the frame.

11. Slabbing machine according to claim 10, wherein the structure is movable in direction (y) along the frame.

* * * * *